US010243313B2

(12) United States Patent
Dinh

(10) Patent No.: US 10,243,313 B2
(45) Date of Patent: Mar. 26, 2019

(54) CABLE COMPRESSION DIE ASSEMBLY FOR CRIMP CONNECTIONS

(71) Applicant: Thomas & Betts International LLC, Wilmington, DE (US)

(72) Inventor: Cong Thanh Dinh, Collierville, TN (US)

(73) Assignee: Thomas & Betts International LLC, Wilmington, DE (US)

( * ) Notice: Subject to any disclaimer, the term of this patent is extended or adjusted under 35 U.S.C. 154(b) by 216 days.

(21) Appl. No.: 15/183,887

(22) Filed: Jun. 16, 2016

(65) Prior Publication Data

US 2017/0012398 A1 Jan. 12, 2017

Related U.S. Application Data

(60) Provisional application No. 62/189,514, filed on Jul. 7, 2015.

(51) Int. Cl.
*H01R 43/058* (2006.01)
*H01R 43/04* (2006.01)

(52) U.S. Cl.
CPC ..... *H01R 43/058* (2013.01)

(58) Field of Classification Search
CPC .... B21D 41/00; H01R 43/058; Y10T 29/5367
See application file for complete search history.

(56) References Cited

U.S. PATENT DOCUMENTS

| | | | | |
|---|---|---|---|---|
| 3,800,584 | A | 4/1974 | Edwards, Sr. et al. | |
| 4,942,757 | A * | 7/1990 | Pecora | H01R 43/0427 72/416 |
| 5,421,186 | A * | 6/1995 | Lefavour | H01R 43/042 72/409.01 |
| 5,511,307 | A | 4/1996 | Reiersgaard et al. | |
| 5,592,738 | A | 1/1997 | Reiersgaard et al. | |
| 5,775,158 | A * | 7/1998 | Hensley | B23D 23/00 30/180 |
| 5,802,908 | A * | 9/1998 | Frenken | B25B 7/04 29/751 |
| 6,035,692 | A | 3/2000 | Lucas | |
| 6,170,145 | B1 | 1/2001 | Lucas | |
| 7,010,857 | B2 | 3/2006 | Gloaguen | |
| 7,544,892 | B2 | 6/2009 | Susai et al. | |
| 8,312,625 | B2 | 11/2012 | Kumakura | |
| 2009/0255319 | A1 | 10/2009 | Sokol | |
| 2010/0120288 | A1 | 5/2010 | Drew et al. | |
| 2011/0030211 | A1 | 2/2011 | Kumakura | |

(Continued)

*Primary Examiner* — Minh Trinh
(74) *Attorney, Agent, or Firm* — Taft Stettinius & Hollister LLC; J. Bruce Schelkopf

(57) ABSTRACT

A cable compression die assembly is used in connection with a compression tool for compressing a stranded cable prior to crimping. Upper and lower compression dies each have a semicircular groove to compress the cable. A plurality of extending blocks guides each die into sliding engagement. The stranded cable will be compressed between the upper and lower compression dies to a reduced cable radius. Compressing generally reduces or eliminates air spaces between the stranded cable wire strands. A subsequent crimp connection forms a nearly monolithic structure to maximize current flow between two crimp connected compressed stranded cables.

6 Claims, 14 Drawing Sheets

(56) References Cited

U.S. PATENT DOCUMENTS

| | | | | |
|---|---|---|---|---|
| 2015/0229091 | A1* | 8/2015 | Loncar | B23P 11/005<br>29/751 |
| 2017/0012398 | A1* | 1/2017 | Dinh | H01R 43/058 |
| 2017/0201056 | A1* | 7/2017 | Malloy | H01R 43/058 |

* cited by examiner

CABLE COMPRESSION DIE ASSEMBLY FOR CRIMP CONNECTIONS

CROSS REFERENCE TO RELATED APPLICATIONS

This application claims priority to U.S. Provisional Patent Application No. 62/189,514, filed on Jul. 7, 2015, the contents of which are incorporated herein by reference in its entirety.

FIELD OF THE INVENTION

The present invention is directed to crimping wire cables and, more particularly, is directed to an apparatus and method for compressing wire cable strands prior to crimping.

BACKGROUND OF THE INVENTION

Crimp connections are widely used in industry to connect two electrical conductors or wire cables together. Crimp connections are also used to fasten a ring lug or spade lug to the end of a single cable. The cable or cable pair is inserted into the cable crimp connector, which is then compressed tightly around the cable with a compression tool. With small gauge wire strand cable, the tool is typically manually squeezed to compress the cable connector. In the case of large gauge wire strand cable, the compression tool is typically operated by mechanical leverage or hydraulic pressure.

FIGS. 1-3 show a compression tool 44 having a fixed anvil, or upper jaw 46; and a movable spindle, or lower jaw 48. It is to be understood that the compression tool 44 can be oriented in any position, vertical, horizontal, angled, the upper and lower portions reversed, and that these orientations are equivalent for the purposes disclosed herein. Crimping dies are installed in the compression tool 44. An upper crimp die 26 is mounted in the upper jaw 46. A lower crimp die 28 is mounted in the lower jaw 48. In FIG. 1, a C-shaped cable connector 30 is disposed in the lower crimp die 28. Upper 42 and lower 42 multi-strand wire cables are received in the cable connector 30. Each cable 42 comprises multiple individual wires 36. In FIG. 2, the lower jaw 48 is raised until the cable connector 30 contacts the upper crimp die 26. In FIG. 3, the lower jaw 48 is raised with force, until the cable connector 30 is squeezed around the cables 42. The resultant connection is shown in FIG. 4. Numerous air pockets or spaces 38 may exist between the wires 36. Air spaces 38 may be present around the outer periphery of each cable, between the wire strands and the cable connector 30. These air spaces 38 could reduce the current carrying capacity of the connection.

SUMMARY OF THE INVENTION

In one aspect, a cable compression die assembly is used for compressing a stranded cable for subsequent termination in a cable connector. The cable compression die assembly comprises a pair of cable compression dies for directly accommodating the stranded cable therebetween. The dies are accommodated within a compression tool. The dies are compressingly closable about the stranded cable by the compression tool. This will reduce spaces between strands of the stranded cable.

In another aspect, an assembly terminates a stranded cable to a cable connector. The assembly comprises an operable compression tool. A pair of cable compression dies is insertable into the compression tool for compression of the stranded cable. This will reduce spaces between strands of the stranded cable. A pair of connector crimping dies is insertable into the compression tool. The dies receive the cable connector and the compressed stranded cable therebetween for crimping the cable connector to the compressed stranded cable.

In yet another aspect, a method of terminating a stranded cable to a cable connector comprises the steps of providing a compression tool. A pair of cable compression dies is inserted into the compression tool. The stranded cable is inserted between the cable compression dies. The stranded cable is compressed between the cable compression dies with the compression tool. This will reduce spaces between wire strands of the stranded cable. The compressed stranded cable is removed from the compression tool.

The cable compression dies are removed from the compression tool. A pair of connector crimping dies is inserted into the compression tool. The cable connector is inserted between the connector crimping dies. The compressed stranded cable is inserted into the cable connector. The cable connector is crimped about the compressed stranded cable using the compression tool.

These and other aspects, objectives, features, and advantages of the disclosed technologies will become apparent from the following detailed description of illustrative embodiments thereof, which is to be read in connection with the accompanying drawings.

Figure 1:
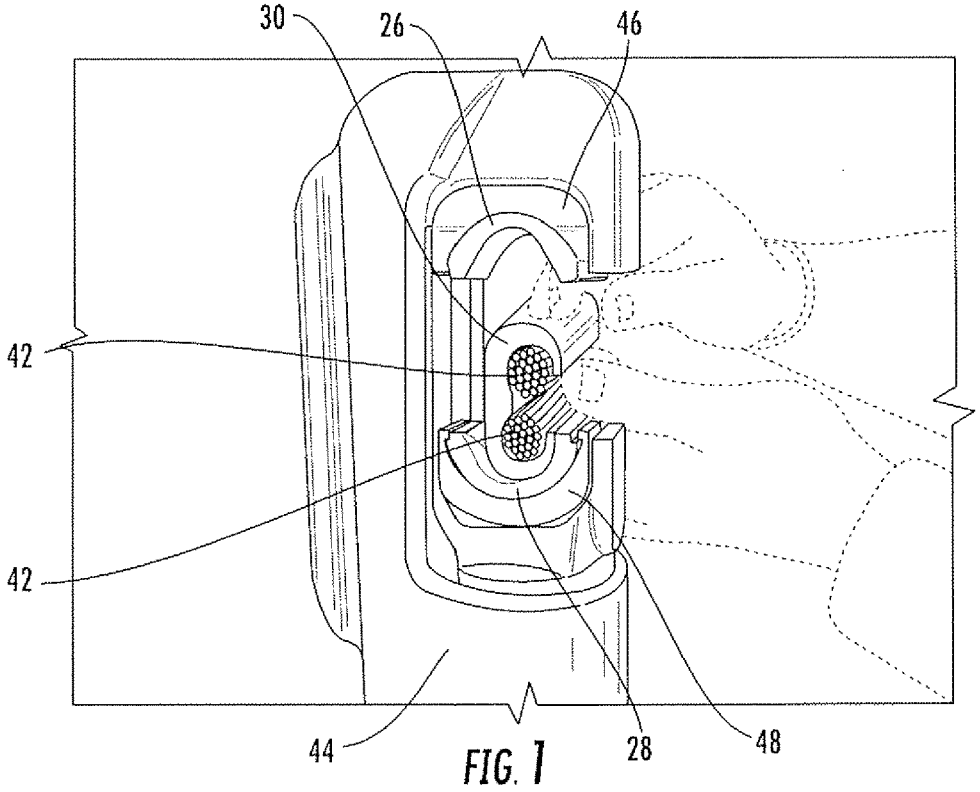
FIG. 1 PRIOR ART
FIG. 1 is a front elevational view of a prior art compression tool used in connection with the disclosed technologies, showing a cable connector, crimp dies, and two cables.
Figure 2:
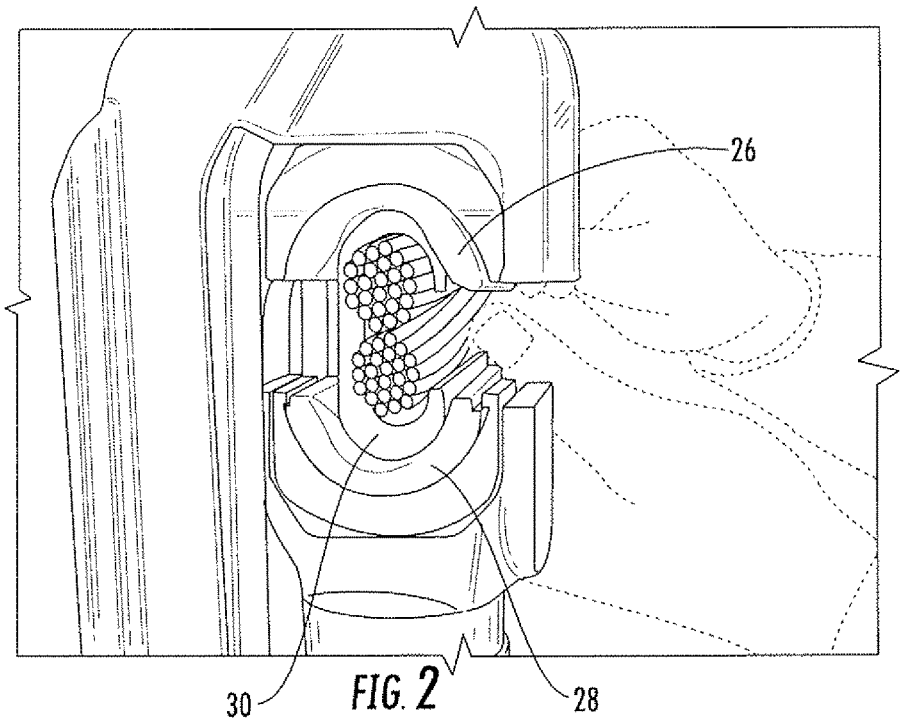
FIG. 2 PRIOR ART
FIG. 2 is a front elevational view of the prior art compression tool of FIG. 1, showing the upper and lower jaws moving toward one another.
Figure 3:
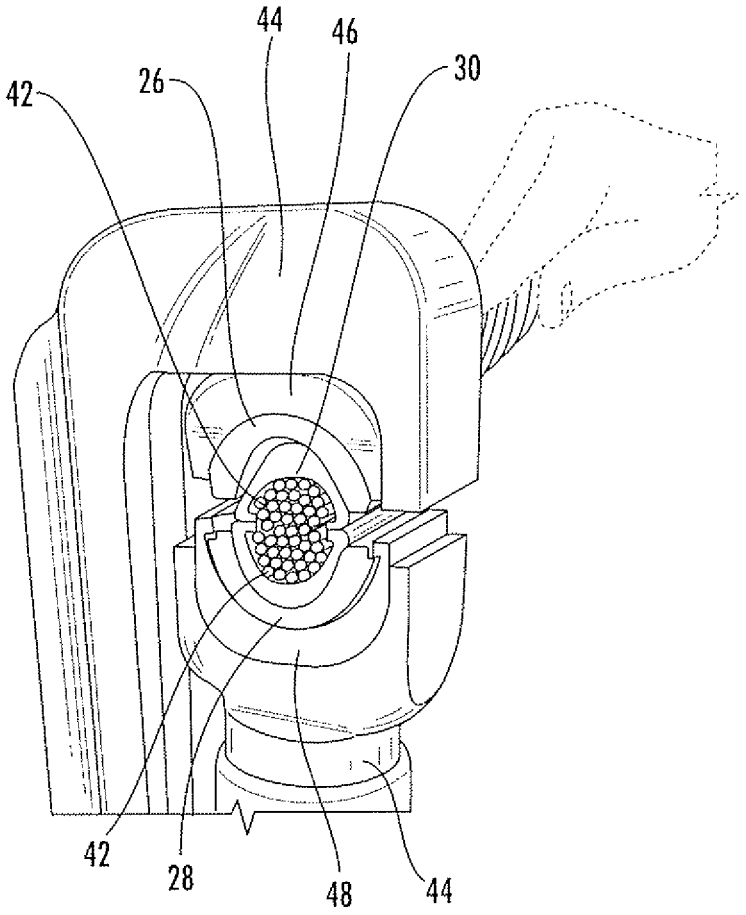
FIG. 3 PRIOR ART
FIG. 3 is a front elevational view of the prior art compression tool of FIG. 1, showing the crimping.
Figure 4:
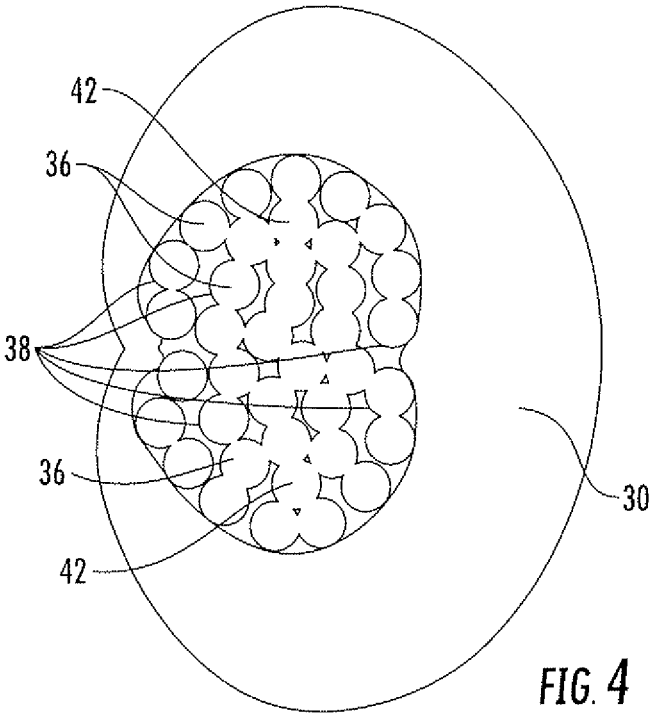
FIG. 4 PRIOR ART
FIG. 4 shows a prior art connection having numerous air spaces in between the wire strands and between the cables and the cable connector.

It should be noted that the drawings herein are not to scale.

DETAILED DESCRIPTION OF THE PREFERRED EMBODIMENTS

Describing now in further detail these exemplary embodiments with reference to the FIGS. 5-24, as well as FIGS. 1-4 as described above. The present invention employs the compression tool 44 shown in FIGS. 1-4 to pre-compress stranded cable 42 using a cable compression die assembly 40, so as to reduce the spaces 38 between the strands 36 of the cable. Thereafter, the compression tool 44 is used to terminate the connector 30 to the compressed cable 32, 34 using connector crimp dies 26, 28 to form a superior connection between the cable 32, 34 and the connector 30.

Figure 6:
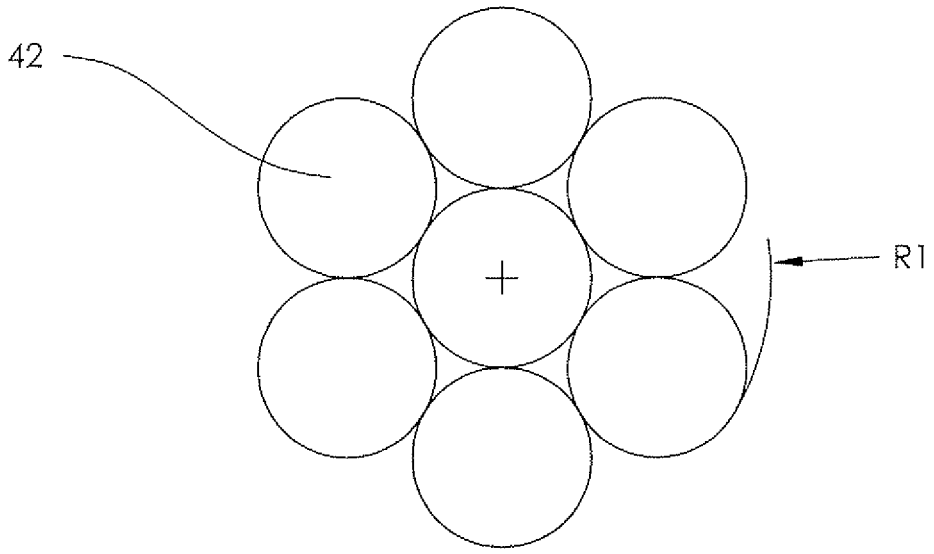
FIG. 6 is a cross-sectional view of a wire strand cable before compression.
Figure 7:
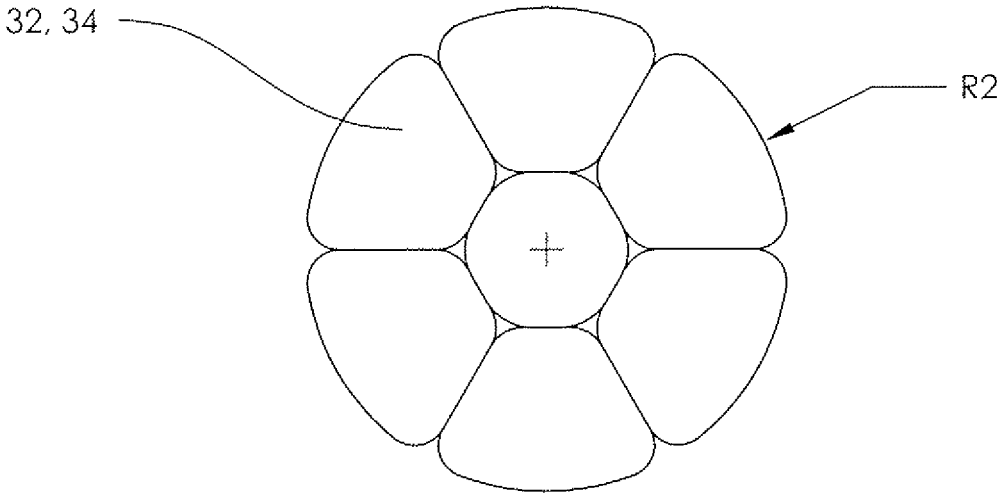
FIG. 7 is a cross-sectional view of a wire strand cable after compression.
Figure 8:
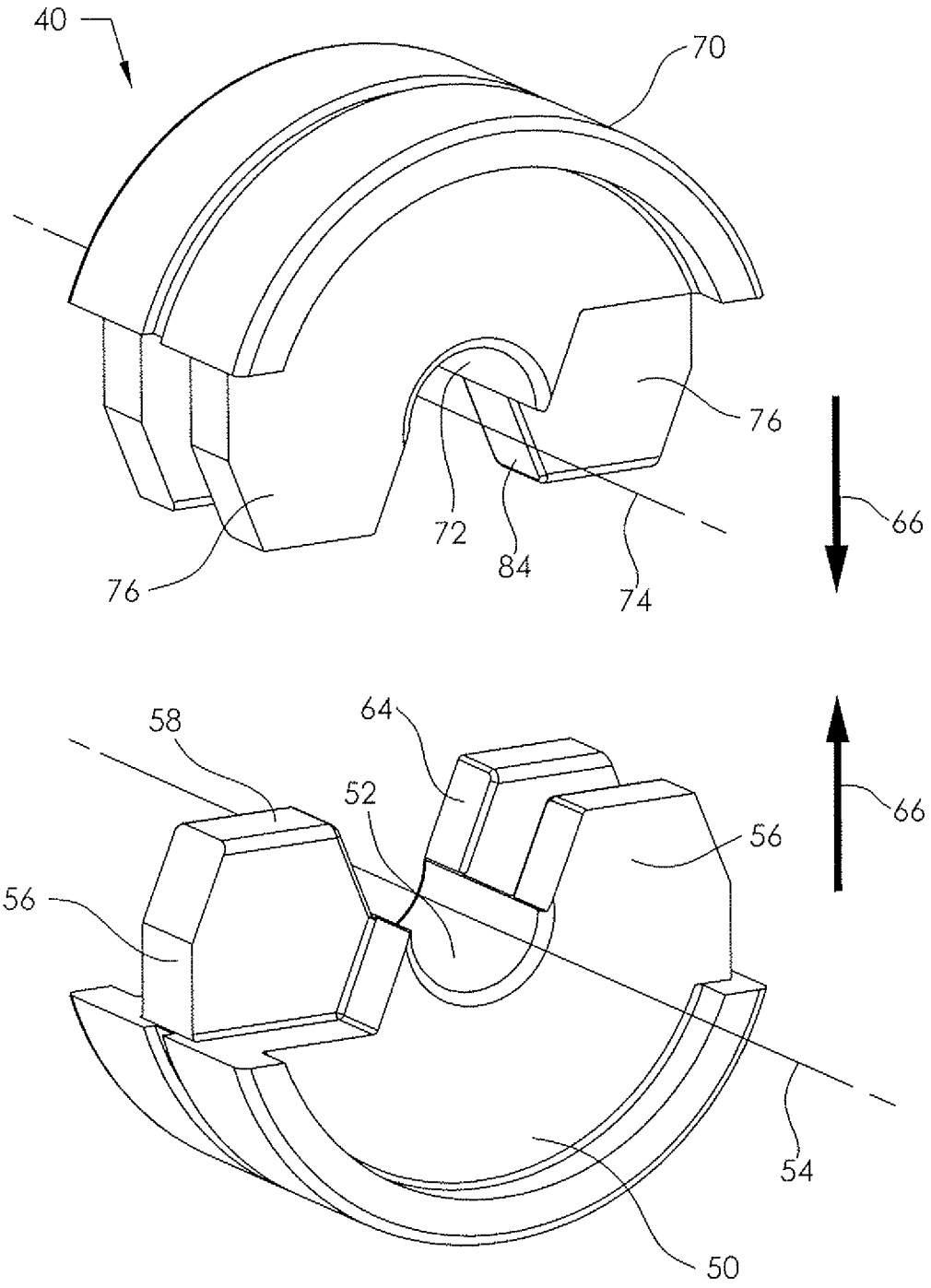
FIG. 8 is a front exploded perspective view of a cable compression die assembly constructed in accordance with the invention.

The compression tool 44 has an upper jaw 46 and a lower jaw 48 adapted for moving toward one another. The cable 42 has a predetermined cable first radius R1 prior to compressing, as shown in FIG. 6. The cable 42 has a predetermined cable second radius R2 after compressing, as shown in FIG. 7. Note that after compression the air spaces in between the wire strands are greatly reduced in size, or eliminated.

The cable compression die assembly 40 comprises a lower compression die 50 having a lower groove 52 semicircular about a lower axis 54. The lower groove 52 has a radius generally equal to the cable second radius R2. The lower groove 52 is adapted to receive and compress the cable 42. The lower compression die 50 is adapted for mounting in the compression tool lower jaw 48.

An upper compression die 70 has an upper groove 58 semicircular about an upper axis 74. The upper groove 58 has a radius generally equal to the cable second radius R2. The upper groove 58 is adapted to receive and compress the cable 42. The upper compression die 70 is adapted for mounting in the compression tool upper jaw 46 opposite the lower compression die 50 so that the lower axis 54 and the upper axis 74 are generally parallel.

Figure 9:
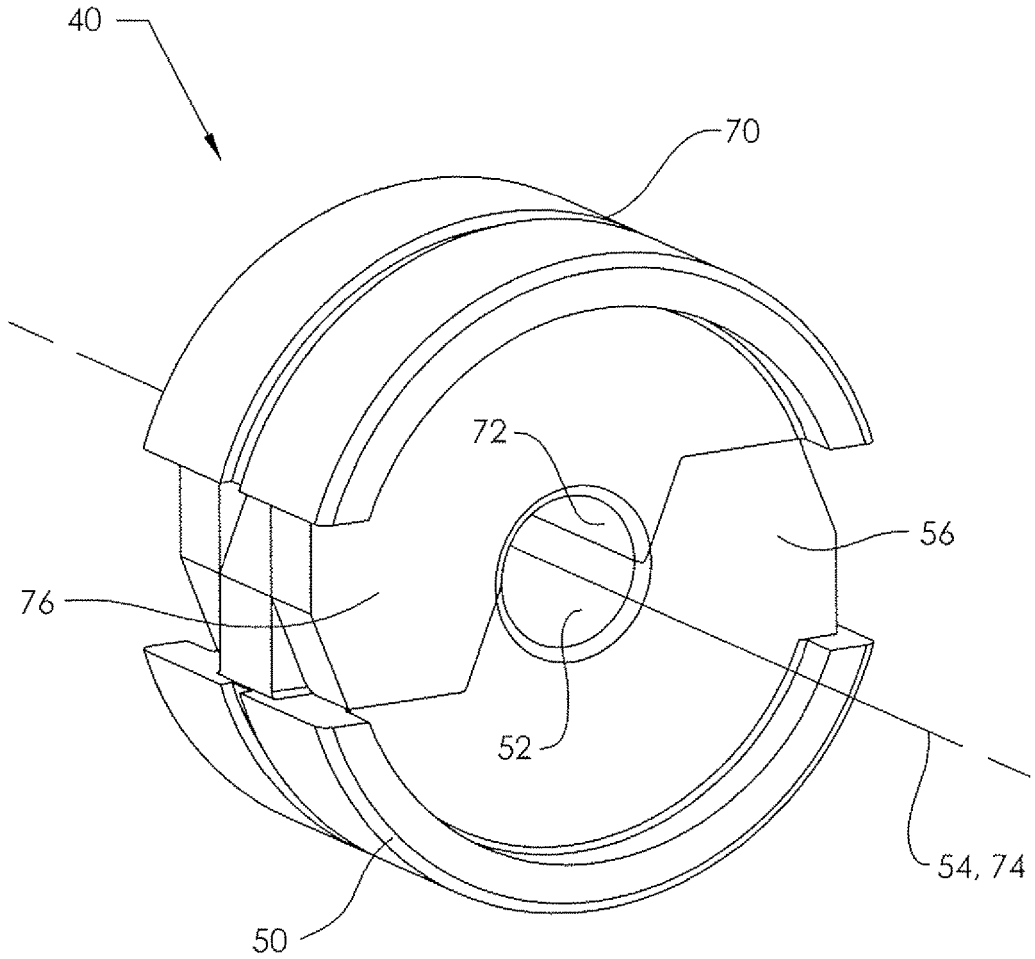
FIG. 9 is a front contracted perspective view of the cable compression die assembly of FIG. 8.

Upon moving the lower jaw 48 and the upper jaw 46 toward one another, the lower compression die 50 and the upper compression die 70 will move toward one another in a closing direction 66. The lower axis 54 and the upper axis 74 will converge, as shown in FIG. 9. The cable 42 will be compressed between the lower compression die 50 and the upper compression die 70 to the cable second radius R2. This will generally reduce or eliminate air spaces 38 between the wire strands 36. The cross-sectional area of the lower and upper grooves 52, 58 of the fully closed compression die assembly 40 is approximately equal to the cross-sectional area of all the wire strands 36 of the stranded cable 42 added together.

Figure 5:
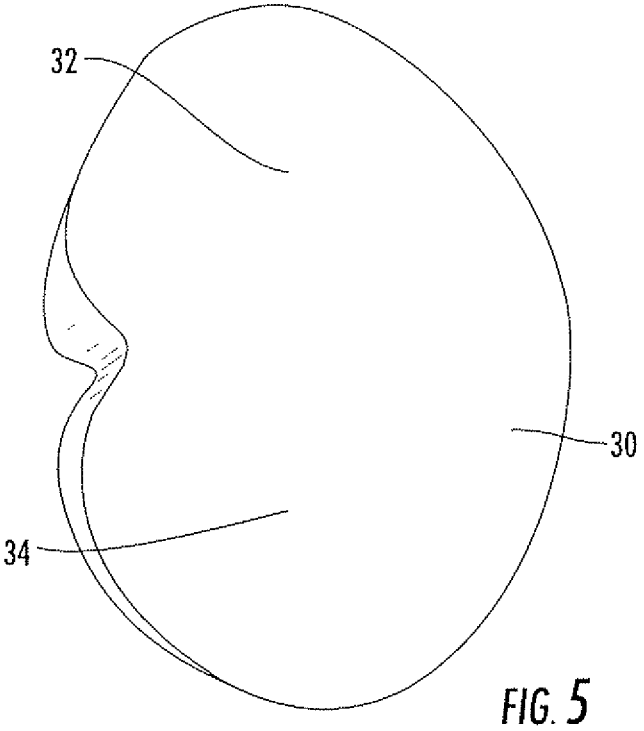
FIG. 5 shows a connection made with the invention and having minimal air spaces in between the wire strands and between the cables and the cable connector.

FIG. 5 shows a pair of cables 32, 34 which have been first compressed by the invention, then crimped into a crimp connection. Notice only a small number of reduced air pockets or spaces 38 are visible. Hence, the connection has reduced air spaces. This connection can now carry more current than the prior art connection, because of greater surface contact between the wire strand conductors 36.

Figure 10:
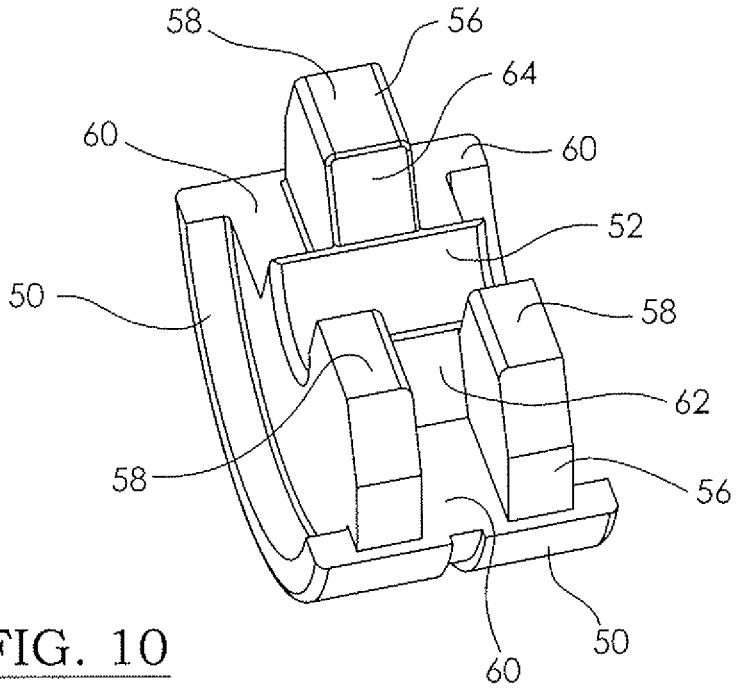
FIG. 10 is a top perspective view of a lower compression die of the cable compression die assembly of FIG. 8.
Figure 11:
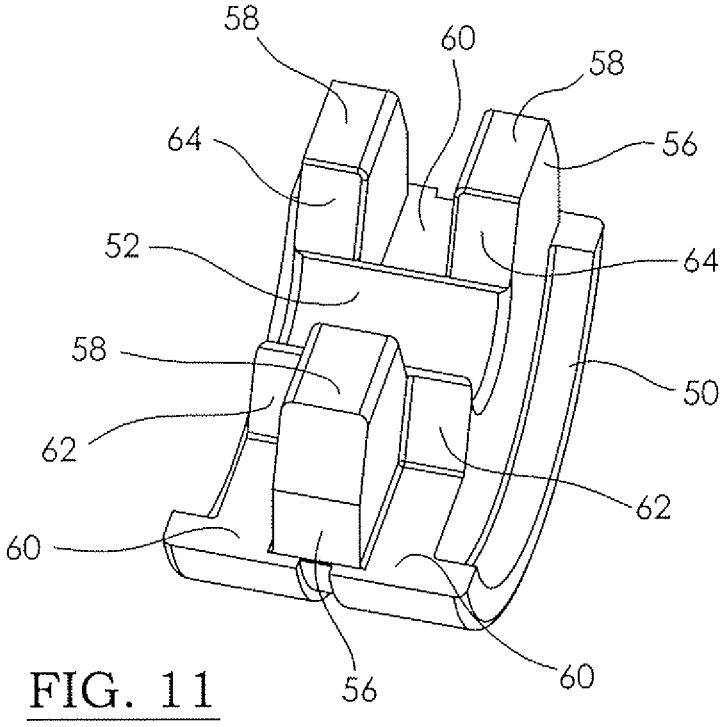
FIG. 11 is another top perspective view of the lower compression die of the cable compression die assembly of FIG. 8.

As shown in FIGS. 10-11, the lower compression die 50 includes a plurality of lower guide blocks 56 extending upward from the lower compression die 50 in the closing direction 66. The lower guide blocks 56 have lower terminal ends 58 disposed above the lower axis 54. The lower terminal ends 58 are generally planar, or flat, meaning approximately lying in a plane, but not perfectly planar. The lower terminal ends 58 are generally perpendicular, or transverse, to the closing direction 66, meaning approximately at right angles, but not perfectly ninety degrees. The lower compression die 50 has lower base flats 60 disposed below the lower axis 54 and generally parallel to the lower terminal ends 58. Generally parallel means flat and spaced apart, not perfectly parallel. The lower base flats 60 are generally planar and generally perpendicular to the closing direction 66.

Figure 12:
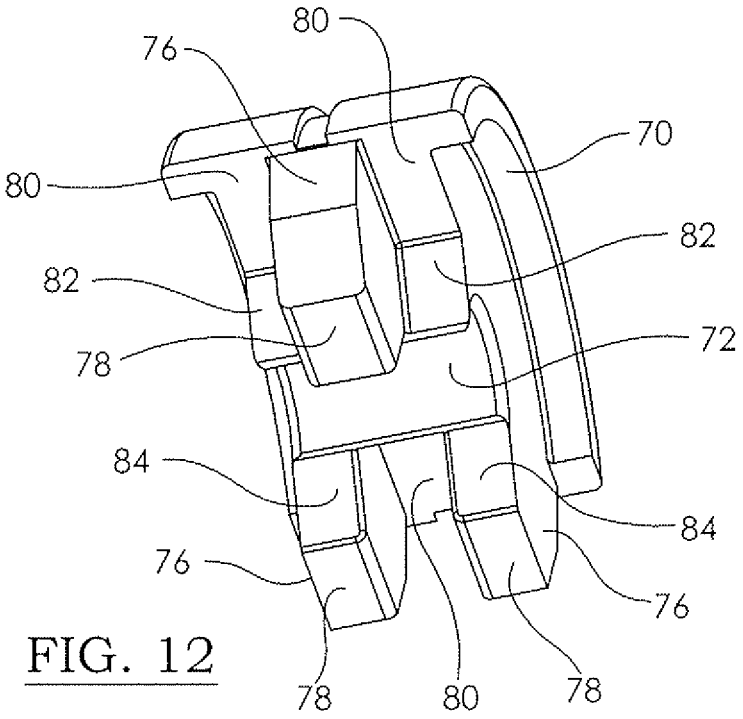
FIG. 12 is a bottom perspective view of an upper compression die of the cable compression die assembly of FIG. 8.
Figure 13:
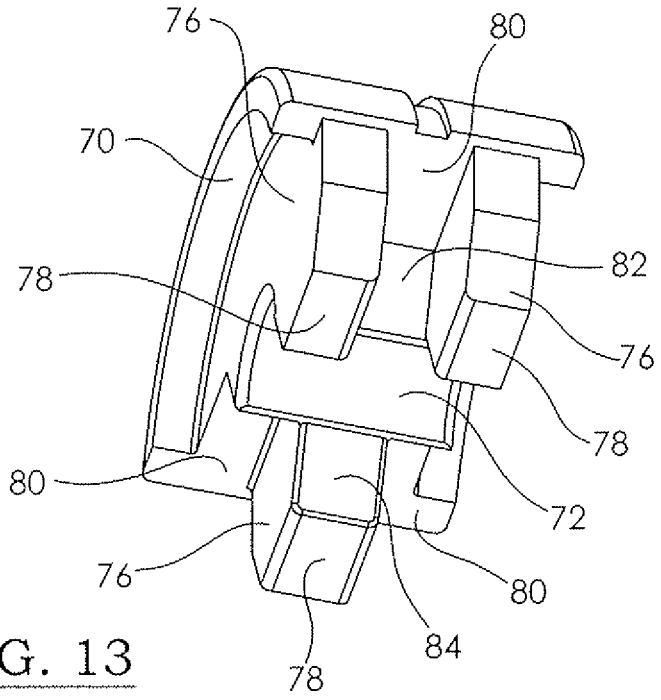
FIG. 13 is another bottom perspective view of the upper compression die of the cable compression die assembly of FIG. 8.
Figure 19:
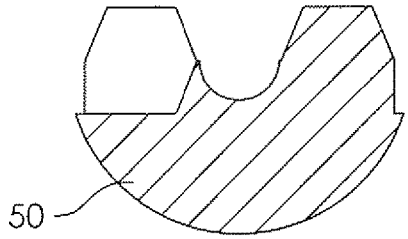
FIG. 19 is a front elevational cross-sectional view of the lower compression die of the cable compression die assembly of FIG. 8, taken along lines 19-19 of FIG. 17.
Figure 18:
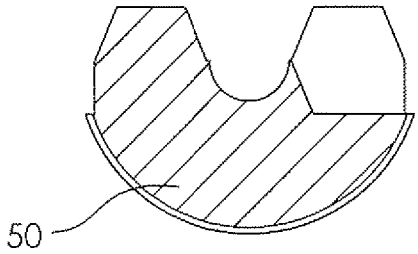
FIG. 18 is a front elevational cross-sectional view of the lower compression die of the cable compression die assembly of FIG. 8, taken along lines 18-18 of FIG. 17.
Figure 17:
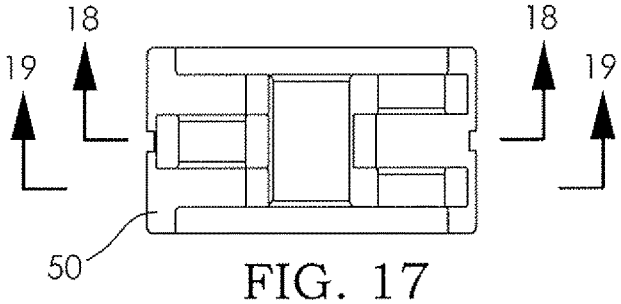
FIG. 17 is a top plan view of the lower compression die of the cable compression die assembly of FIG. 8.
Figure 16:
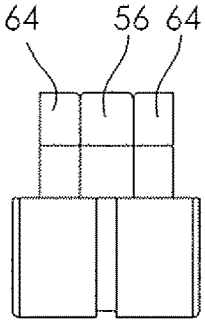
FIG. 16 is a left side elevational view of the lower compression die of the cable compression die assembly of FIG. 8.
Figure 14:
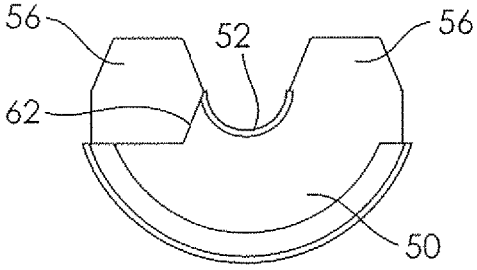
FIG. 14 is a front elevational view of the lower compression die of the cable compression die assembly of FIG. 8.
Figure 15:
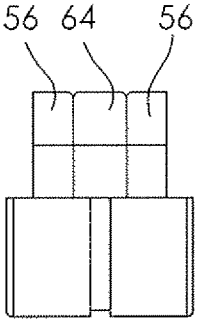
FIG. 15 is a right side elevational view of the lower compression die of the cable compression die assembly of FIG. 8.
Figure 20:
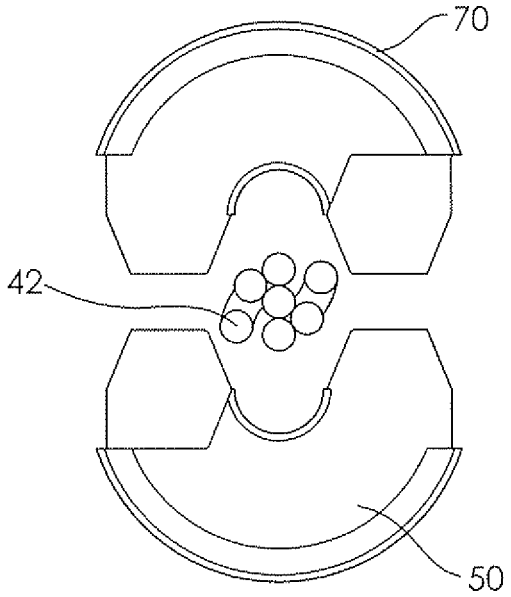
FIG. 20 is a front elevational view of the cable compression die assembly of FIG. 8 with a cable before compression, showing the dies open.
Figure 21:
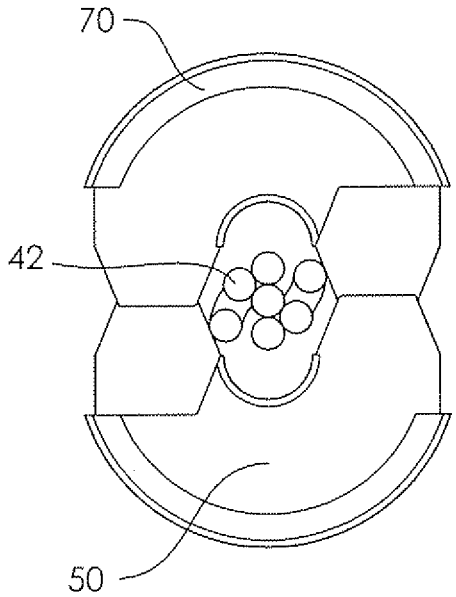
FIG. 21 is a front elevational view of the cable compression die assembly of FIG. 8 with a cable before compression, showing the dies starting to close.
Figure 22:
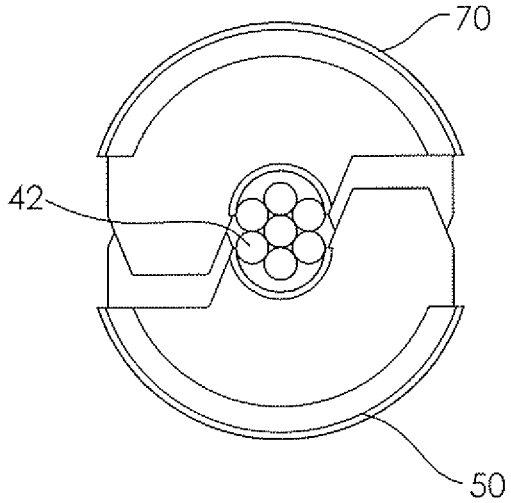
FIG. 22 is a front elevational view of the cable compression die assembly of FIG. 8 with a cable during compression, showing the wire strands pushed inward.
Figure 23:
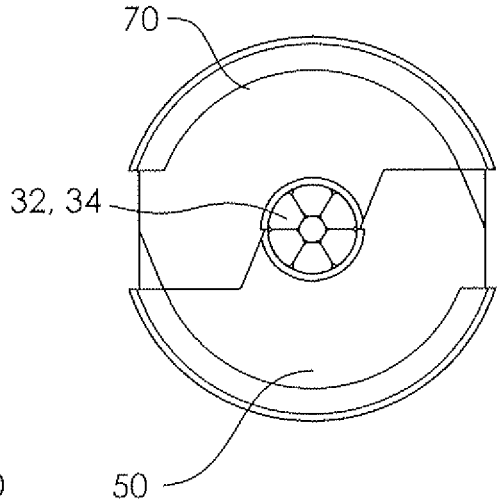
FIG. 23 is a front elevational view of the cable compression die assembly of FIG. 8 with a cable after compression.

As shown in FIGS. 12-13, the upper compression die 70 includes a plurality of upper guide blocks 76 extending downward from the upper compression die 70 in the closing direction 66. The upper guide blocks 76 have upper terminal ends 78 disposed below the upper axis 74. The upper terminal ends 78 are generally planar and generally perpendicular to the closing direction 66. The upper compression die 70 has upper base flats 80 disposed above the upper axis 74 and generally parallel to the upper terminal ends 78. The upper base flats 80 are generally planar and generally perpendicular to the closing direction 66.

A pair of the upper guide blocks 76 is adapted to straddle and slidingly engage a one of the lower guide blocks 56. Similarly, a pair of the lower guide blocks 56 is adapted to straddle and slidingly engage a one of the upper guide blocks 76. This occurs upon moving the lower compression die 50 and the upper compression die 70 toward one another. This will serve to guide the lower 50 and upper 70 compression dies into alignment together axially. The upper guide block upper terminal ends 78 are adapted to contact the lower compression die lower base flats 60 and the lower guide block lower terminal ends 58 are adapted to contact the upper compression die upper base flats 80 to delimit the moving toward one another. Thus, the upper 78 and lower 58 terminal ends will establish a solid purchase upon the upper 80 and lower 60 base flats as the upper 70 and lower 50 dies contact one another. This limit is essential to preclude overcompressing the cable which could extrude cable material in an axial direction. The limit also serves to preclude damaging the dies.

The lower compression die 50 includes a plurality of lower outward facets 62 that are beveled and face outward, generally away from the lower axis 54. The lower guide blocks 56 have a plurality of lower inward facets 64 that are beveled and face inward generally toward the lower axis 54.

The upper compression die 70 includes a plurality of upper outward facets 82 that are beveled and facing outward generally away from the upper axis 74. The upper guide blocks 76 have a plurality of upper inward facets 84 that are beveled and face inward generally toward the upper axis 74.

The upper compression die upper outward facets 82 are adapted to engage the lower guide blocks lower inward facets 64 and the lower compression die lower outward facets 62 are adapted to engage the upper guide blocks upper inward facets 84. In the event that the dies are not precisely aligned in the compression tool 20, the upper 84 and lower 64 inward facets will guide the upper 70 and lower 50 compression dies into alignment together transversely. In the event that the dies are precisely aligned in the compression tool, the upper 84 and lower 64 inward facets will touch as the dies reach the limit of moving together in the closing direction 66. Furthermore, it often happens that one or more wire strands 36 are bent or displaced outward away from the cable 42 sufficiently that they will not fit into the cable compression die. In these cases, the upper 84 and lower 64 inward facets are adapted to push outward displaced wire strands 36 inward toward the cable 42 so that the wire strands 36 are closely adjacent, in preparation for compression. Closely adjacent means all strands of the multiple stranded wire cable are sufficiently close to one another that the cable will fit into the cable compression die in preparation for compressing. Yet furthermore, the upper 84 and lower 64 inward facets are adapted to guide the cable 42 into the upper 72 and lower 52 grooves for compression. The compression die assembly 40 is circumferentially closed as the compression of the stranded cable 42 begins. Thus, no stray outward displaced wire strands 36 can escape compression in the compression die assembly 40.

Figure 25:
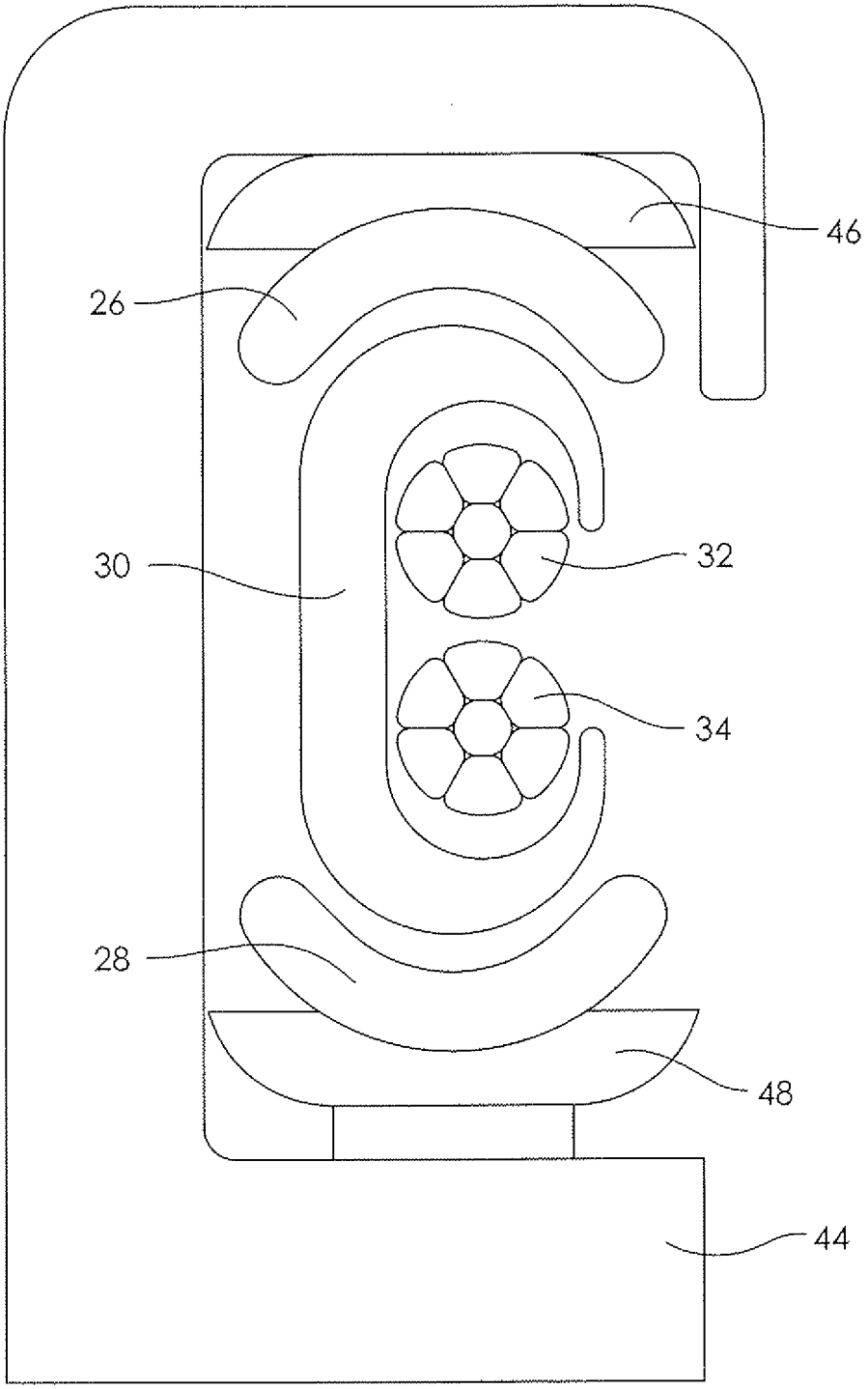
FIG. 25 is a front elevational view of the compression tool used with the invention, a cable connector, crimp dies, and two compressed stranded cables, showing the start of the connection process.
Figure 26:
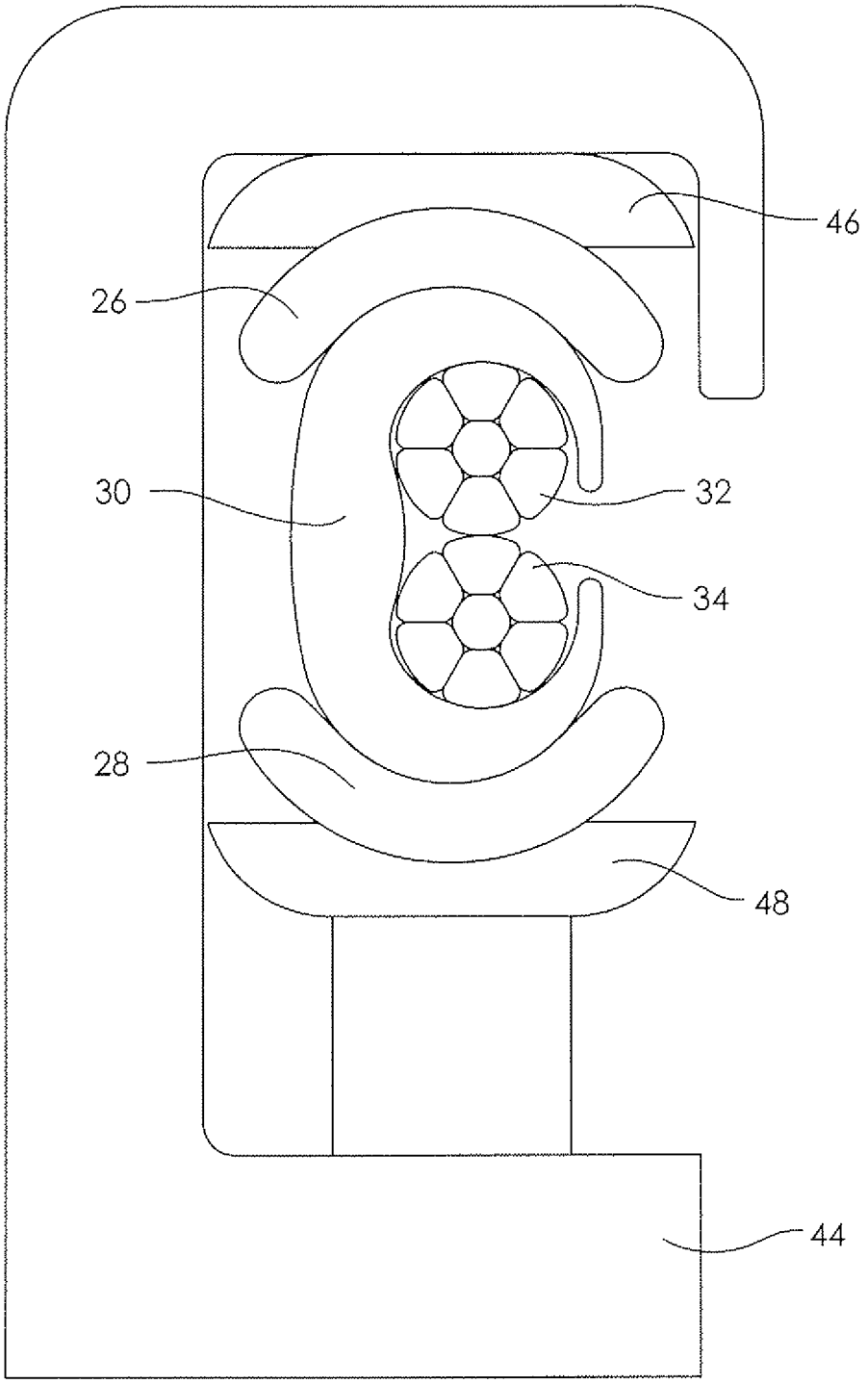
FIG. 26 is a front elevational view of the compression tool used with the invention, a cable connector, crimp dies, and two compressed stranded cables, showing the connection process partly completed.
Figure 27:
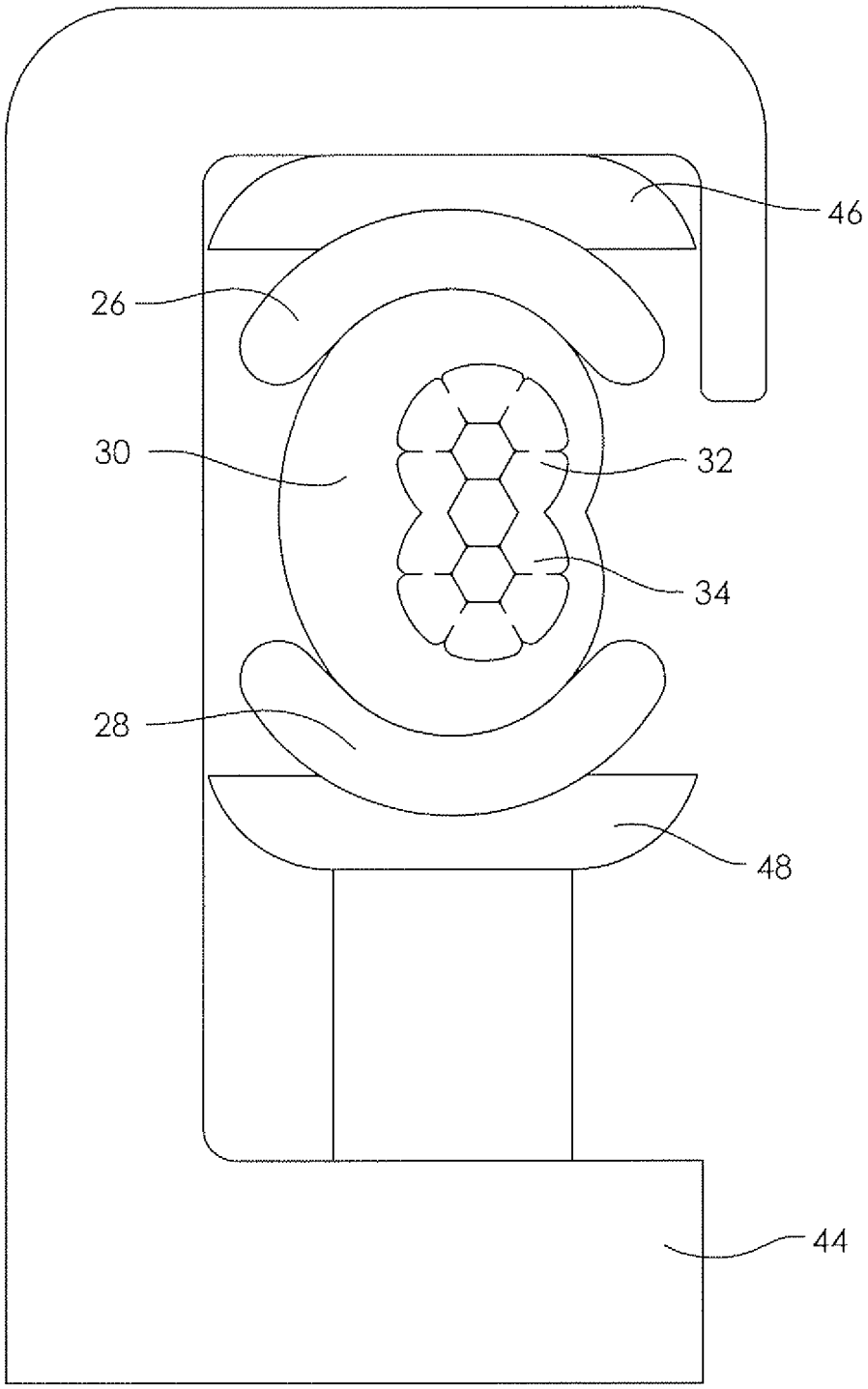
FIG. 27 is a front elevational view of the compression tool used with the invention, a cable connector, crimp dies, and two compressed stranded cables, showing the connection process completed.

After compression of two stranded cables 42, the resultant compressed cables are ready to be connected together in the crimp connector 30. As shown in FIG. 25, the upper crimp die 26 is mounted in the compression tool upper jaw 46. The lower crimp die 28 is mounted in the compression tool lower jaw 48. The crimp connector 30 is inserted into the upper 26 and lower 28 crimp dies. The first compressed cable 32 is received in the upper portion of the connector 30. The second compressed cable 34 is received in the lower portion of the connector 30. As shown in FIG. 26, the compression tool upper jaw 46 and lower jaw 48 are brought together and are beginning to close the connector 30 around the first 32 and second 34 compressed cables. As shown in FIG. 27, the compression tool upper jaw 46 and lower jaw 48 are brought together with great force to fully close and compress the connector 30 around the first 32 and second 34 compressed cables.

The air spaces 38 between the wire strands 36 are greatly reduced and generally or almost eliminated. Generally eliminating air spaces means the included air spaces after compression and crimping are fewer than with crimping alone. Generally eliminating air spaces can also be defined to mean minimizing air spaces.

Figure 24:
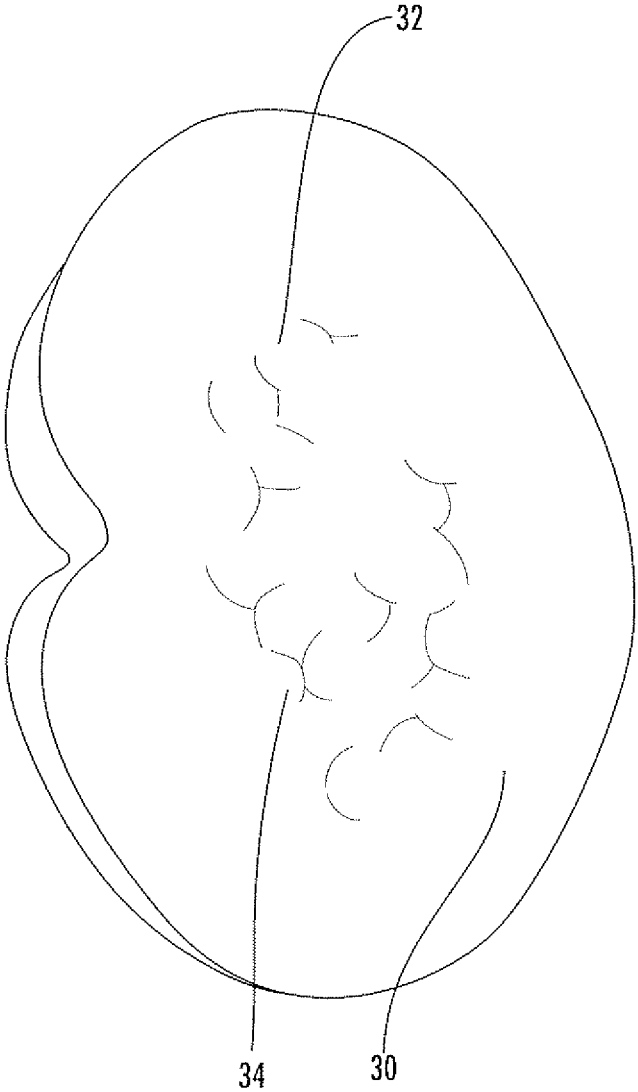
FIG. 24 is a cross-sectional view of a connection made with the invention and showing the wire strands and the cables and the cable connector formed into a monolithic structure.

The structure of the resultant connection is generally or nearly monolithic, as shown in FIG. 24. A generally monolithic structure means that air spaces have been minimized or eliminated between individual wire strands of a multiple stranded wire cable. A generally monolithic structure does not mean perfectly homogeneous in structure or density, since in practice, there will exist small spaces in the structure. A generally monolithic structure Can also be defined to mean solid, but with the understanding that it is not perfectly solid, and may include air spaces. The electrical connection can now carry increased current in comparison with the prior art connection.

In the preferred embodiment shown, the upper 70 and lower 50 compression dies are identical to one another. Furthermore, the die assembly 40 can be oriented in any direction. The preferred embodiment shows a vertical orientation with the compression tool upper jaw 46 at the top and the lower jaw 48 at the bottom of FIGS. 1-3. The die assembly 40 is shown in the Figures with the upper compression die 70 at the top, and the lower compression die 50 at the bottom. It is to be understood that the compression tool 44 and the die assembly 40 and the upper 70 and lower 50 compression dies can be oriented in any position, vertical, horizontal, angled, the upper and lower portions reversed, and that these orientations are equivalent within the spirit and scope of the claims.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A cable compression die assembly configured to be accommodated within a compression tool, for compressing a stranded cable for subsequent termination in a cable connector, the cable compression die assembly comprising:

lower compression die, the lower compression die having a lower groove semicircular about a lower axis and a plurality of lower guide blocks extending upward from top edges of the lower groove and lower base flats of the lower compression die, the lower groove being adapted to receive and compress the cable, the lower compression die being adapted for mounting in a lower jaw of the compression tool;

and an upper compression die having an upper groove semicircular about an upper axis and a plurality of upper guide blocks extending downward from bottom edges of the upper groove and upper base flats of the upper compression die, the upper groove being adapted to receive and compress the cable, the upper compression die being adapted for mounting in an upper jaw of the compression tool opposite the lower compression die such that the lower axis and the upper axis are generally parallel.

2. The cable compression die assembly of claim 1, wherein the upper jaw of the compression tool and the lower jaw of the compression tool are adapted for moving toward one another, the stranded cable having multiple wire strands and a predetermined cable first radius prior to compressing and a predetermined cable second radius after compressing, wherein the lower groove has a radius generally equal to the cable second radius, and the upper groove has a radius generally equal to the cable second radius, and wherein upon moving the lower jaw and the upper jaw toward one another, the lower compression die and the upper compression die will move toward one another in a direction defined as a closing direction with respect to the opposite die, with the lower axis and the upper being converged and compressing the cable between the lower compression die and the upper compression die to the cable second radius, to eliminate air spaces between the wire strands.

3. The cable compression die assembly of claim 2, wherein the lower guide blocks have lower terminal ends disposed above the lower axis, and the lower base flats are disposed below the lower axis and generally parallel to the lower terminal ends, wherein the upper guide blocks have upper terminal ends disposed below the upper axis, and the upper base flats are disposed above the upper axis and generally parallel to the upper terminal ends, and wherein the upper guide blocks being adapted to slidingly engage the lower guide blocks upon moving the lower compression die and the upper compression die toward one another, so as to guide the lower and upper compression dies into alignment together axially, the upper guide block upper terminal ends being adapted to contact the lower compression die lower base flats and the lower guide block lower terminal ends being adapted to contact the upper compression die upper base flats to delimit the moving toward one another so as to preclude overcompressing the cable and damaging the dies.

4. The cable compression die assembly of claim 3, further comprising:

the lower compression die includes a plurality of lower outward facets being beveled and facing outward generally away from the lower axis, the lower guide blocks having a plurality of lower inward facets being beveled and facing inward generally toward the lower axis; and the upper compression die includes a plurality of upper outward facets being beveled and facing outward generally away from the upper axis, the upper guide blocks having a plurality of upper inward facets being beveled and facing inward generally toward the upper axis;

wherein the upper compression die upper outward facets being adapted to engage the lower guide blocks lower inward facets and the lower compression die lower outward facets being adapted to engage the upper guide blocks upper inward facets, so as to guide the lower and upper compression dies into alignment together transversely, and the upper and lower guide blocks respective upper and lower inward facets are adapted to push outward displaced wire strands inward toward the cable so that the wire strands are closely adjacent, and to guide the cable into the upper and lower grooves for compression.

5. The cable compression die assembly of claim 4, wherein the upper and lower compression dies are identical to one another.

6. The cable compression die assembly of claim 2, wherein the cable compression die assembly can be oriented in a vertical, horizontal, or angled position.

* * * * *